United States Patent [19]

Kelsey

[11] Patent Number: 4,610,112

[45] Date of Patent: Sep. 9, 1986

[54] APPARATUS FOR GRINDING AND/OR RECONDITIONING PLANE, ANNULAR SURFACES

[76] Inventor: John Kelsey, 424 Wessex Rd., Valparaiso, Ind. 46383

[21] Appl. No.: 650,841

[22] Filed: Sep. 17, 1984

[51] Int. Cl.[4] ..... B24B 15/02

[52] U.S. Cl. ..... 51/241 VS

[58] Field of Search ..... 51/241, 241 S, 241 VS, 51/241 A, 245, 120

[56] References Cited

U.S. PATENT DOCUMENTS

| | | | |
|---|---|---|---|
| 757,053 | 4/1904 | Rameau . | |
| 771,194 | 9/1904 | Williams . | |
| 772,431 | 10/1904 | Rameau . | |
| 1,138,683 | 5/1915 | Murray . | |
| 1,142,570 | 6/1915 | La Hodny . | |
| 1,412,867 | 4/1922 | Hill . | |
| 2,572,485 | 10/1951 | Hunter et al. . | |
| 2,649,669 | 8/1953 | Tobis . | |
| 2,674,069 | 4/1954 | Bauer . | |
| 2,720,736 | 10/1955 | McAfee . | |
| 2,794,303 | 6/1957 | Wickes . | |
| 2,865,142 | 12/1958 | Dunipace . | |
| 3,393,474 | 7/1968 | Buswell . | |
| 3,648,416 | 3/1972 | Rogers | 51/241 VS |
| 4,000,584 | 1/1977 | Uyetake et al. | 51/241 VS |
| 4,007,561 | 2/1977 | Okano et al. | 51/241 VS |
| 4,050,836 | 9/1977 | Anders | 51/241 A |
| 4,114,323 | 9/1978 | Okano et al. | 51/241 VS |
| 4,287,688 | 9/1981 | Jensen | 51/241 VS |

FOREIGN PATENT DOCUMENTS 2400077 7/1975 Fed. Rep. of Germany .

OTHER PUBLICATIONS

Brochure (pp. 0–13) Machinebau GMBH & Co. KG, Postfach 285, D5260 Duren, West Germany.

One page from phamplet Maschinenfabrik A. Hauerwas GMBH & Co. KG, Postfach 285, D5260 Duren, West Germany.

One page from phamplet, EFCO Machinenbau GMBH & Co. KG, Postfach 527, D–5160 Duren, West Germany.

One page of 2 photographs, UNISLIP GMBH, Postfach 7220, D–5180 Eschweiler, West Germany.

Germany Utility Model 8,303,975, EFCO–Maschinenbau GMBH & Co. KG.

*Primary Examiner*—Roscoe V. Parker

*Attorney, Agent, or Firm*—Guy E. Matthews

[57] ABSTRACT

An apparatus and method for the grinding and reconditioning of valve seats utilizing adjustable, rotatable satellite grinding wheels to change the diameter of the annular surface defined by the grinding action to match that of the valve, or the faying ring that is to be reconditioned. The satellite wheels are carried, in a freely rotatable manner, on the periphery of a planetary wheel and secured to slide blocks movable within doveways having radial slots for adjustment of the satellite wheels to vary the diameter. Through the utilization of slide blocks with angular faces in conjunction with rasp or file-type rotatable grinding wheels, the pitch of the satellite wheels can be changed, and excess material resulting from the grinding of the valve or faying ring can be cut away, thereby restoring the valve seating surface to the original widths prescribed by the manufacture. This combination also allows the user to change the angle of relief of the valve seating from an unknown to a known angle.

18 Claims, 12 Drawing Figures

APPARATUS FOR GRINDING AND/OR RECONDITIONING PLANE, ANNULAR SURFACES

BACKGROUND OF THE INVENTION

The present invention generally relates to the grinding of plane, annular surfaces. In particular, this invention relates to the grinding and resurfacing of annular valves surfaces and the faying rings of valves used in pipe or pipe connections for industrial, commercial, and/or residential applications.

DESCRIPTION OF THE PRIOR ART

A surface grinding apparatus comprising a plurality of rotatable satellite grinding wheels attached to a central rotating wheel has been described in the prior art in U.S. Pat. No. 4,287,688. However, the apparatus described therein has the dimensions of a central rotating wheel, and satellite grinding wheels which are immovable relative to the annular faces that are subjected to the grinding action.

Another problem with the grinding apparatus of the prior art is the reduction of valve sealing ability due to widening of the valve seating surface upon reconditioning of the valve. Once the surface of the valve seat exceeds approximately fifty-five percent of the available seating surface of the disc or gate that seals against the valve seat, the valve is considered scrap or salvage. Standard operating procedure for narrowing the width of reconditioned valve seats is to use a single plate with an angular champher cut into the plate to which adhesive grinding papers are attached and used to grind away the excess material. This technique is used by only the most highly skilled within the valve reconditioning industry, and requires a particular plate for each particular size valve. Such procedure may necessitate the utilization of as many as fifteen plates for one valve size diameter.

Still further, when utilizing the grinding tools of the prior art, it is difficult to re-establish the valve manufacturer's valve angle for that particular valve.

SUMMARY OF THE INVENTION

In view of the foregoing, the present invention provides new and useful improvements in tools for the grinding and reconditioning of valve seats, by providing means for the adjustment of the rotatable satellite grinding wheels in order to change the diameter of the annular surface defined by the grinding action to match that of the valve, or the faying ring, that is to be reconditioned. The central rotating wheel of the apparatus of the present disclosure details a plurality of doveways arranged along the periphery of the central, or planetary, wheel an equal distance from each other and an equal distance from the center of the planetary wheel.

The satellite wheels are carried in a freely rotatable manner on the periphery of the planetary wheel, such satellite wheels being rotatable about their respective axes of rotation which are substantially parallel to the axes of the planetary wheel. The satellite wheels are also secured to slide blocks movable within the doveways for adjustment of the satellite wheels to varying diameters. These slide blocks may have flat surfaces with the satellite wheels being mounted with their axes disposed parallel (the angle of infinity) with the axis of the planetary wheel, or may have angular faces where the satellite wheels are mounted with their axes disposed at a selected angle with respect to the axis of the planetary wheel. The slide blocks are attached to the planetary wheel through radial slots disposed in the seat of the doveway, and are secured to the planetary wheel by T-nuts and adjustment screws, in combination. The T-nuts are fitted into adjustment slots located on the bottom surface of the planetary wheel, such adjustment slots being congruent with the radial slots disposed within the doveways. Graduated marks are provided on the planetary wheel along the adjustment slots so that exact adjustments of the satellite wheels may be achieved.

This invention contemplates the utilization of a rasp or file-type rotatable grinding wheel, as well as an adhesive-type grinding surface. Through the utilization of slide blocks with angular faces in conjunction with rasp or file-type rotatable grinding wheels, the pitch of the satellite wheels can be changed, and excess material resulting from the grinding of the valve or faying ring can be cut away, thereby restoring the valve seating surface to the original widths prescribed by the manufacturer. This combination also allows the user to change the angle of relief of the valve seating from an unknown to a known angle.

Additional and further features of the present invention, particularly with the reference to the drive mechanism and adaptation of the satellite wheels to varying diameters and pitches, will become more apparent from the following description of the preferred embodiment in conjunction with the accompanying drawings.

DESCRIPTION OF THE PREFERRED EMBODIMENTS

Figure 1:
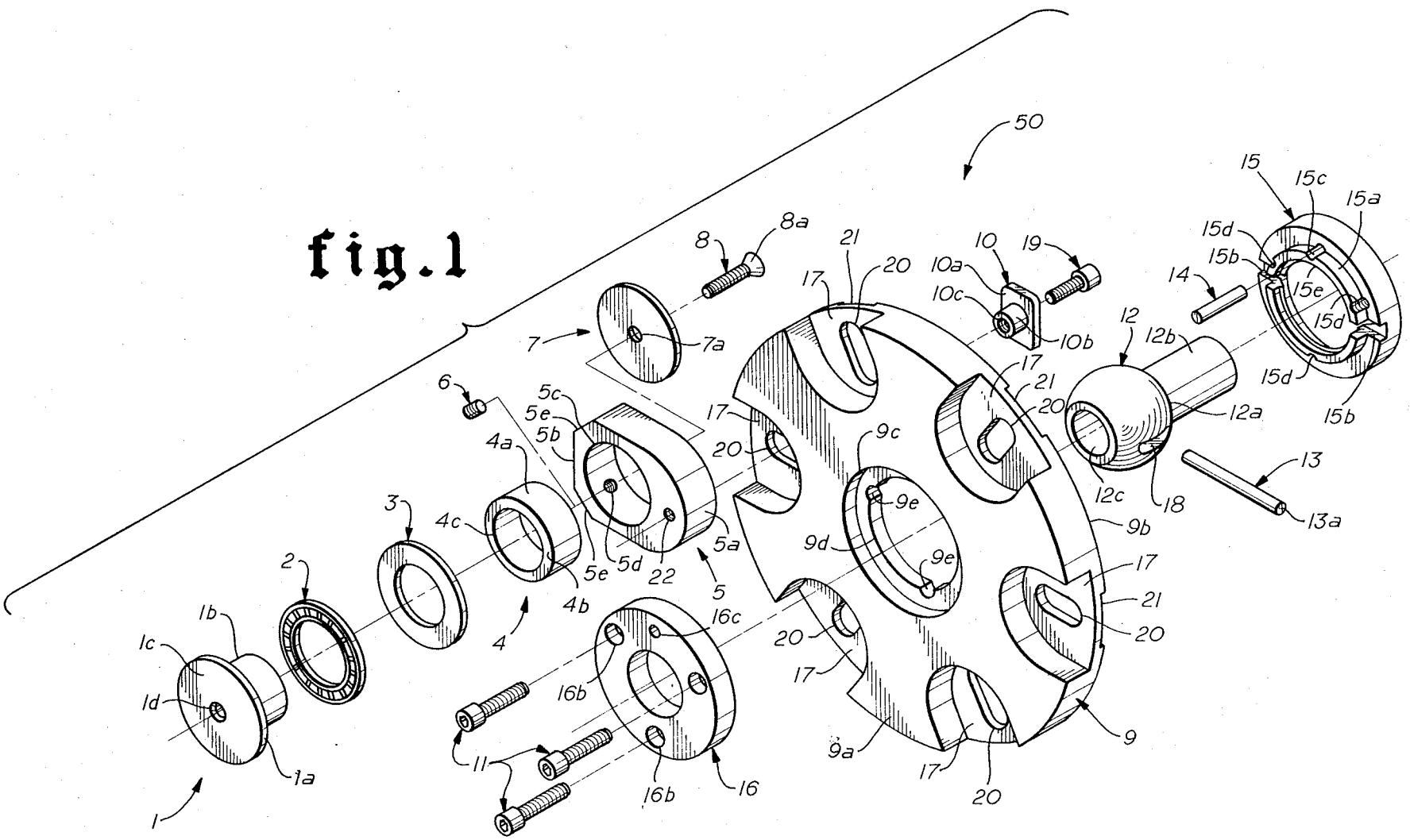
FIG. 1 is an exploded perspective view of a disassembled rotary valve reconditioning apparatus as disclosed in the present invention.
Figure 2:
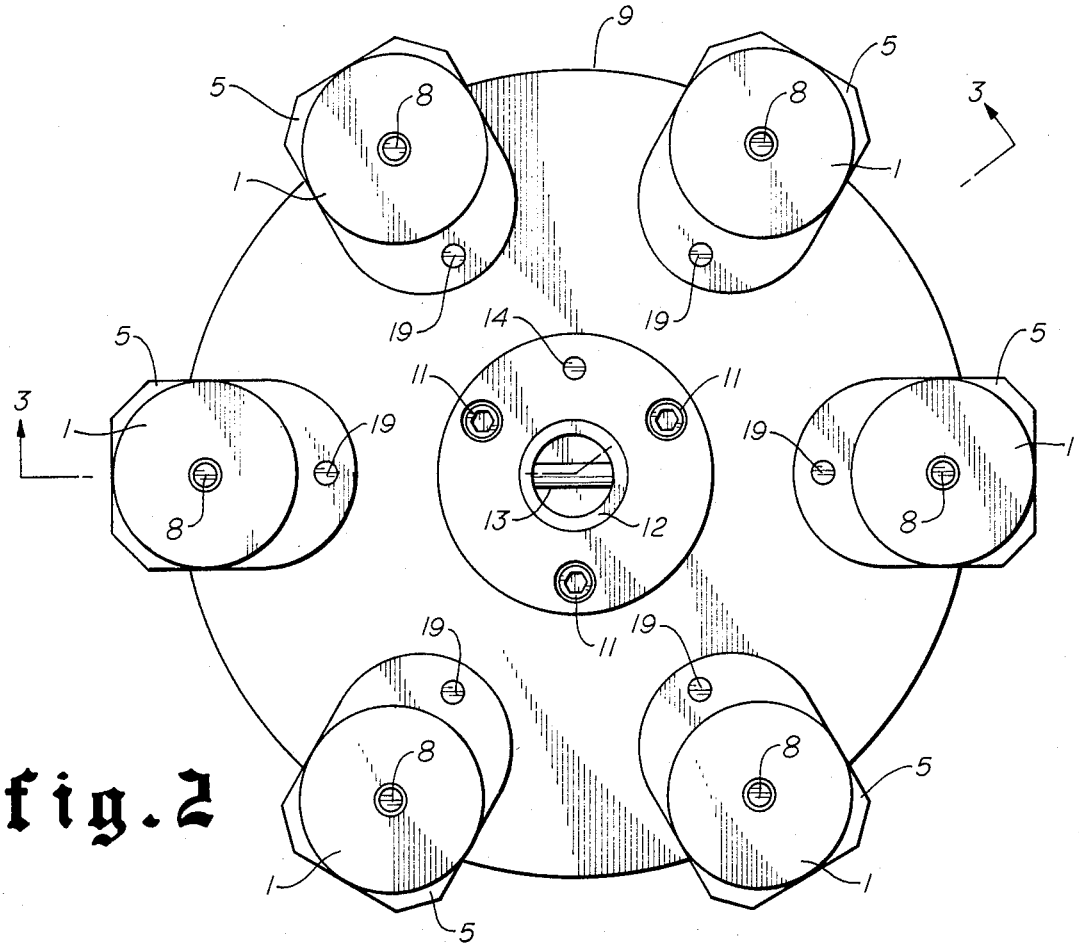
FIG. 2 is an assembled front end view of the rotary valve reconditioning apparatus of the present invention.
Figure 3:
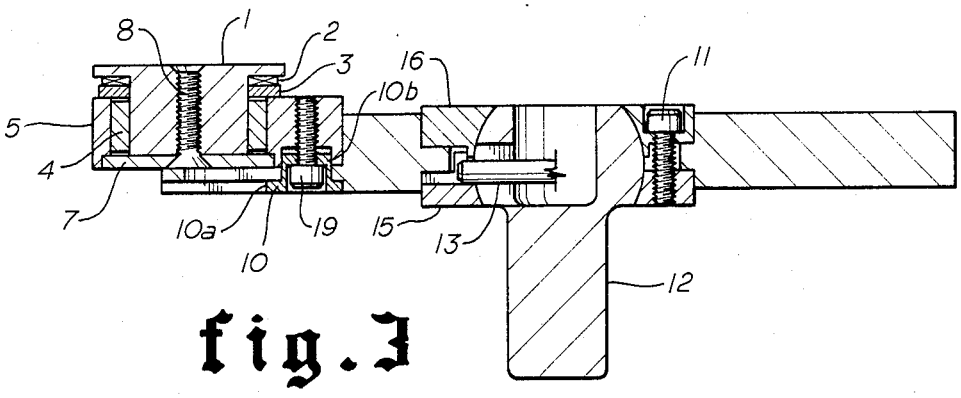
FIG. 3 is a cross-sectional view taken along the line A—A of FIG. 2.

With reference to FIGS. 1 through 3, there is disclosed illustratively the valve reconditioning apparatus of the present invention, generally indicated by the reference numeral 50. As illustrated, the valve reconditioning apparatus 50 details a planetary wheel 9, adapted for appropriate attachment to a drive means (not shown), and a plurality of satellite wheels 1 arranged in equally-spaced relation about the outer peripheral top surface of the planetary wheel 9. Planetary wheel 9 is attached to the drive means through the provision of a coupler ball 12 through which rotational movement is imparted to the planetary wheel 9.

For purposes of clarity, applicant will first describe, with specificity, the planetary wheel 9 as disclosed herein. Descriptions of satellite wheel 1 and coupler ball 12 will follow, with adequate descriptions of the other component parts of the apparatus then ensuing.

For purposes of description, the top surface of planetary wheel 9 will be referred to as 9*a* with the bottom surface thereof being referred to as 9*b*. As can be seen in FIG. 1, planetary wheel 9 may be generally described as being of a flat, circular configuration with an aperture 9*c* extending through the center thereof. Aperture 9*c* details an inwardly radially extending shoulder 9*d* having a plurality of axially-aligned semi-circular slots 9*e* disposed upon its inner circumferential surface. Planetary wheel 9 also displays a plurality of radially projecting, generally arcuate doveways 17 which are equally-spaced about the outer periphery thereof within its top surface 9*a*. As can be readily seen, each doveway 17 is provided with a centrally located, radially extending adjustment slot 20 which extends from the seat of doveway 17 through the bottom surface 9*b* of planetary wheel 9. The bottom surface 9*b* of planetary wheel 9, beneath each doveway 17 and adjustment slot 20, defines a radially extending adjustment groove 21 etched therein.

As indicated above, a plurality of satellite wheels 1 are affixed along the outer periphery of planetary wheel 9. These satellite wheels 1 are advantageously carried in a freely rotatable manner on such periphery of the planetary wheel 9, such satellite wheels 1 being rotatable about their respective axes of rotation which, upon assembly, are substantially parallel to the axis of the planetary wheel 9 and, as later described with reference to FIG. 6, desirably may be disposed at some angle other than parallel to the axis of planetary wheel 9 (with parallel being considered an angle of infinity). wheel 1 details a generally flat, circular grinding head 1*a* having an annular grinding face 1*c*, and a generally cylindrical satellite wheel body 1*b* conformed to detail a unitary structure, such unitary structure having a centrally-located aperture 1*d* extending therethrough. A circular, flat bearing washer 2 is designed to fit onto satellite wheel body 1*b* of satellite wheel 1, as is a circular, flat inner race 3, both said bearing washer 2 and said inner race 3 detailing a centrally-located aperture, the outer circumference of such centrally-located apertures being slightly larger in diameter than the outer circumferential surface of said satellite wheel body 1*b*. That portion of satellite wheel body 1*b* which extends beyond the bearing washer 2 and the inner race 3 is disposed within a slide block bushing 4, with inner race 3 bearing against its annular surface 4*a*.

A plurality of slide blocks 5 (FIGS. 1, 3 and 5) are adapted to fit within the doveways 17. Illustratively, each slide block 5 is configured such that it is rounded on its inner end 5*a*, while detailing bevelled surfaces 5*e* on its outer end 5*b*, such slide block 5 being adapted to be snugly fitted within doveway 17. One of the bevelled surfaces 5*e* of the outer end 5*b* of slide block 5 is disposed with a screw hole 5*d*.

Figure 5:
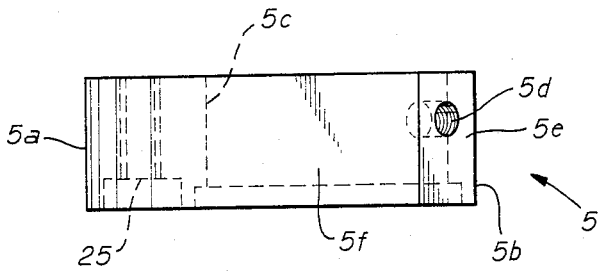
FIG. 5 is a side view in cross-section of the slide block of the present invention.

As can be seen more clearly in FIG. 5, the bottom surface of slide block 5, at its rounded inner end 5*a*, defines a T-nut slot 25 which extends vertically upwardly for a distance into slide block 5.

Figure 7A:
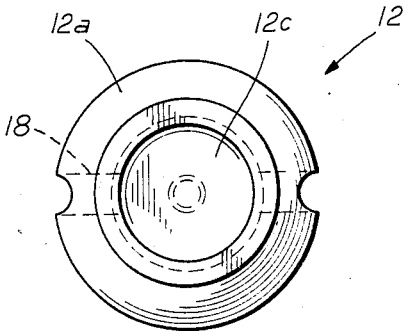
FIG. 7*a* is a perspective view of the coupler ball of the present invention.
Figure 7:
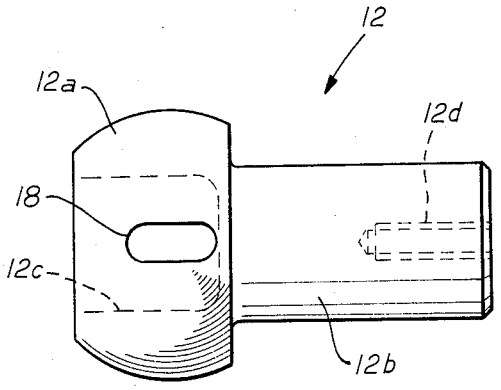
FIG. 7 is a side view of the coupler ball of the present invention.

Referring now to FIGS. 1, 3 and 7, coupler ball 12, as a unitary structure, details a generally spherical, coupler ball head 12*a* with a central, axially aligned aperture 12*c* disposed herein and a generally cylindrical shaft extension 12*b*. Shaft extension 12*b* is axially attached to coupler ball head 12*a* at its proximal end, while defining a centrally disposed, axially aligned, hexagonal insert 12*d* at its distal end (FIG. 7). As clearly seen in FIG. 7*a*, coupler ball head 12*a* further details an elongate, radially extending coupler ball slot 18 which intersects coupler ball head aperture 12*c*.

As can be more clearly seen in FIGS. 1 through 3, coupler ball 12 is secured within the centrally-located aperture 9*c* of planetary wheel 9 by an apertured, generally flat, circular coupler support 15 on its bottom surface, and by a coupler bearing 16 on its top surface.

Figure 8:
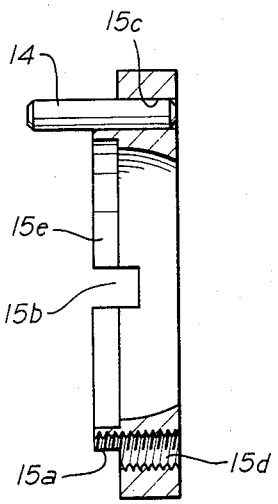
FIG. 8 is a side view in cross-section of the coupler support of the present invention.

As illustrated in FIGS. 1 and 8, coupler support 15 details an upwardly vertically extending annular shoulder 15*a*; a pair of radial slots 15*b* situated 180 degrees apart on the inner circumferential surface of coupler support 15, such slots being disposed completely through shoulder 15*a* and for a distance into the inner circumferential surface of coupler support 15; a plurality of coupler support screw holes 15*d* situated approximately 120 degrees apart, such holes extending through portions of annular shoulder 15*a* to detail a generally semi-circular configuration, and then into coupler support 15; a coupler pinhole 15*c* which also extends through a portion of annular shoulder 15*a* and into coupler support 15, such pinhole 15*c* also detailing a semi-circular configuration as it extends through annular shoulder 15*a*; and a generally arcuate coupler support aperture 15*e*.

Figure 9:
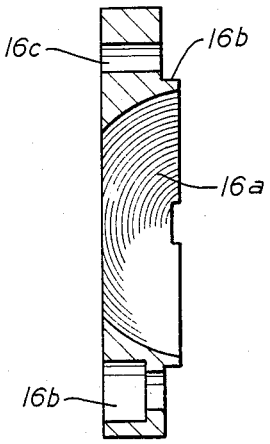
FIG. 9 is a side view in cross-section of the couple bearing of the present invention.

FIGS. 1 and 9 illustrate coupler bearing 16 which also details a generally flat, circular configuration with an arcuate aperture 16*a* extending therethrough. Coupler bearing 16 further defines a plurality of coupler bearing screwholes 16*b*; a coupler pin hole 16*c* disposed through its annular surface; and an inwardly axially extending shoulder 16*d*.

In assemblying coupler ball 12 within the aperture 9*c* of planetary wheel 9, a coupler ball pin 13 is disposed through coupler ball slot 18 of coupler ball 12, with the extremities 13*a* of coupler ball 13 being placed within radial slots 15*b* of coupler support 15. A coupler pin 14 is then inserted into coupler pin hole 15*c* of coupler support 15 prior to inserting coupler support 15 into planetary wheel aperture 9*c*. Preferably, radially extending shoulder 9*d* is centrally situated on the circumference of planetary wheel aperture 9*c*. With such an arrangement, the outer circumferential surface of upwardly vertically extending shoulder 15*a* of coupler support 15 will mate against the inner circumferential surface of planetary wheel aperture shoulder 9*b* such that coupler support screw holes 15*d* and the inner peripheral slots 9*c* of radially extending shoulder 9*b* of planetary wheel aperture 9*a* of planetary wheel 9 will mate to provide circular screw holes therebetween. Upon assembly, coupler support 15 and coupler bearing 16, which detail a like number of similarly situated coupler screw holes 16*b* for mating with coupler support screw holes 15*d*, a coupler pin hole 16*c* for mating with coupler pin hole 15*c* of coupler support 15, and annular shoulder 16*d* are joined within planetary wheel aperture 9*c* against the mated shoulders 9*d* and 15*a* by coupler screws 11 to confine and retain coupler ball 12 thereinbetween.

In further assembling the valve reconditioning apparatus of the present disclosure, an appropriately sized, circular, centrally-apertured bearing washer 2 is fitted onto satellite wheel body 1*b* of satellite wheel 1, as is an appropriately sized, circular, centrally-apertured inner race 3. That portion of satellite wheel body 1*b* which extends beyond the bearing washer 2 and inner race 3 is disposed within slide block bushing 4 with inner race 3 bearing against the annular surface 4*a* of slide block bushing 4. Once assembled, slide block bushing 4 is inserted into the aperture 5*a* of slide block 5. This is possible since the outer circumferential surface 4*a* of slide block bushing 4 is slightly smaller than the inner circumferential surface of slide block aperture 5*c*.

Figure 11:
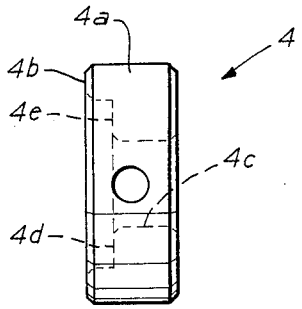
FIG. 11 is a side view of an alternative embodiment of the slide block bushing of the present invention.

FIG. 11 details an alternative embodiment of slide block bushing 4 wherein the slide block bushing aperture 4*c* is narrowed at is bottom end to define a an annular shoulder 44. This alternative embodiment may be employed when utilizing satellite wheels having smaller shafts. Herein, bearing washer 2 and inner race 3 may also be similarly altered and fitted into slide block bushing slot 4*e* upon assembly.

As previously indicated, one of the bevelled surfaces 5*e* of the outer end 5*b* of slide block 5 is disposed with a screw hole 5*d* such that a slide block pin 6 (FIG. 1) may be fitted therein to bear against the outer circumferential surface 4*b* of slide block bushing 4 to retain same within slide block aperture 5*c* of slide block 5.

Figure 10:
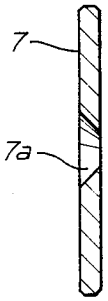
FIG. 10 is a side view in cross-section of the retainer washer of the present invention.

As clearly seen in FIGS. 3 and 5, a centrally apertured retainer washer 7 is disposed within retainer washer slot 5*d* situated on the bottom surface of slide block 5 beneath slide block bushing 4. As can be seen more clearly in FIG. 10, retainer washer 7 defines an angled aperture such that the angled bead 8*a* of satellite wheel screw 8 may fit snuggly therein. As slide block bushing 4 is still the only element associated with satellite wheel 1 which is attached, satellite wheel screw 8 is inserted through the centrally located aperture 7*a* of retainer washer 7 into the centrally located aperture 1*d* of satellite wheel 1 so as to retain satellite wheel 1 within slide block 5 and slide block bushing 4.

To secure slide block 5 within doveway 17 of planetary wheel 9, a T-nut 10 having a generally square base portion 10*a* with an upwardly vertically extending nose 10*b*, both defining a central aperture 10*c* which extends therethrough, is inserted into the T-nut housing 25 disposed on the bottom surface of slide block 5. An adjustment screw 19 may then be inserted through aperture 10*c* of T-nut 10 into the slide block screw hole 22 so as to hold slide block 5 in position within doveway 17.

Figure 4:
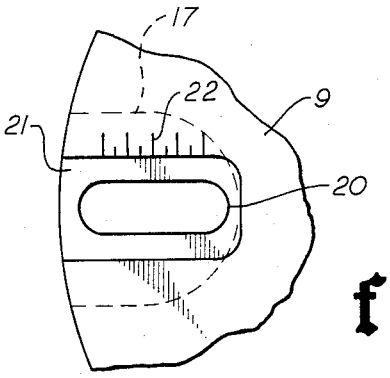
FIG. 4 is an isolated view of the doveway as disclosed in the present invention.

It should become readily apparent to those with skill in the art to which this invention pertains that annular surfaces, or valves and faying rings of varying diameter may be reconditioned or ground, by adjusting the placement of T-nut 10 within adjustment groove 21 of planetary wheel 9 for each slide block 5. The preferred embodiment of the present invention also details, as seen in FIG. 4, graduations being which are stamped or scored on the bottom surface 9*b* of planetary wheel 9 within adjustment grooves 21 so as to insure that the satellite wheels 1 are adjusted an equal distance from the center of planetary wheel 9.

Figure 6:
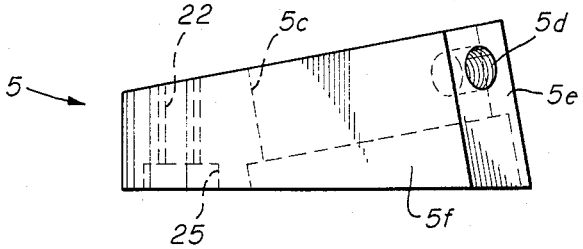
FIG. 6 is a cross-sectional view of the slide block with an angular face as disclosed in the present invention.

FIG. 6 is illustrative of an appropriate angular slide block 5 which may be utilized instead of flat slide blocks 5, as shown in FIGS. 1–3 and 5, to adjust the satellite wheels 1 to match a selected angle of relief of a particular valve seat or faying ring. As can be seen this angular slide block 5 also details a T-nut housing 25, retainer washer slot 5*f*, and screw hole 22 depending therefrom, as well as a screw hole 5*d* disposed within one of the bevelled surfaces 5*e* of the outer end 5*b* thereof. This angular slide block 5 of FIG. 6, when optionally substituted for the flat slide block 5 shown in FIGS. 3 and 5, serves to dispose the axes of satellite wheels 1 at a selected angle other than parallel with the axis of planetary wheel 9, such as shown in FIG. 3.

In utilizing the present invention for reconditioning the faces of valve housings, for example, the drive means of this apparatus maybe mounted to the top valve of the valve housing with the arm of the drive means, which is attached to the coupler ball, extending into the interior of the valve housing so as to position the planetary wheel substantially parallel to the faces of the valve housing. The planetary wheel is then laterally rotated and moved toward the face of the valve housing in order to cause the satellite wheels to bear against the face. The apparatus is then locked into position for grinding.

Prior to placement of the present apparatus into the valve housing, each satellite wheel should be adjusted to a radial distance from the center of the planetary wheel by moving the slide block, attached T-nut, and adjustment screw to similar markings or graduations scored on the bottom surface of the planetary wheel so that upon engagement of the satellite wheels with the valve face, the satellite wheels will rotate about their axes as the planetary wheel is rotated by the drive means. As the planetary wheel is rotated by the drive means, the frictional engagement of the satellite wheels with the valve face causes the satellite wheels to rotate, thereby allowing the grinding surfaces of the satellite wheels to recondition the valve face.

To further adjust the satellite wheels for reconditioning of a valve of another diameter, the apparatus is removed from the valve housing, and the slide blocks and attached satellite wheels are simply moved within the doveways to new markings on the planetary wheel.

To cut away the excess material resulting from reconditioning the valve face, a rasp or file-type satellite wheel is attached within the slide block. The slide block utilized for this type of operation has an angular face adjacent to the satellite wheel which allows the satellite wheel to engage only the edge of the annular surface of the reconditioned valve face. By mounting the apparatus to the valve housing, as heretofore described, rotation of the planetary wheel will cause the satellite wheels to grind away the edge of the reconditioned valve face, thereby restoring the valve face to the original width prescribed by the manufacturer.

From the foregoing description, it can be seen that the present invention provides an improved apparatus for grinding and reconditioning valves by providing means for adjusting the diameter and/or pitch of the grinding satellite wheel. The present disclosure also provides for actually cutting away excess material in a machining operation, as well s grinding or resurfacing operations.

Although only one embodiment of the invention has been described herein, it is understood that variations may be apparent to those skilled in the art, and such modifications or adaptations are intended to be included in the scope of this invention. For example, the inner end 5*a* of slide block 5 may be squared. This particular configuration would serve to enhance the structural ability of the apparatus when said slide blocks are moved radially outwardly toward periphery of the planetary wheel 9. When the slide block 5 with the rounded inner end is moved, further out in the periphery of the planetory whell 9, the likelihood of the slide block shifting during use is increased due to it's rounded configuration. In this embodiment, however, it also becomes necessary to alter the configuration of the doveways 17 to compliment the configuration of the slide block.

It is also to be understood that the phraselogy and terminolgy herein employed are for purposes of description and not of limitation, since the scope of the present invention is devoted in the appended claims.

What is claimed is:

1. Apparatus for grinding plane annular surfaces comprising:

(a) a planetary wheel;

(b) a plurality of satellite wheels carried in a freely rotatable manner on the outer periphery of the top surface of said planetary wheel, said satellite wheels being rotatable about their respective axes of rotation, such axes of rotation being disposed at a selected angle with respect to the axis of said planetary wheel;

(c) means for adjusting each of said satellite wheels respectively to selected radial distances from the center of said planetary wheel to enable grinding of variable diameter annular surfaces;

(d) means for variably positioning said satellite wheels respectively with the axes of said satellite wheels disposed at selected angles with respect to the axis of said planetary wheel; and, (e) drive means for rotating said planetary wheel wherein rotation of said planetary wheel causes grinding of said annular surface.

2. The apparatus of claim 1 wherein said means for variably positioning said satellite wheels include slide blocks, said satellite wheels being respectively affixed to said planetary wheel through said slide blocks, said slide blocks being of a shape to position the axis of said satellite wheels at a selected angle with respect to the axis of said planetary wheel.

3. The apparatus of claim 2 wherein said planetary wheel comprises:

(a) a centrally located aperture adapted for connection to a coupler ball;

(b) a plurality of radially extending, equally-spaced, generally arcuate doveways disposed along the outer periphery of said planetary wheel;

(c) a plurality of radially extending adjustment grooves respectively disposed in each of said doveways; and, (d) a plurality of radially extending adjustment slots respectively disposed adjacent to each of said doveways on the bottom surface of said planetary wheel.

4. The apparatus of claim 3 wherein said slide block means including said slide blocks is adapted to fit within each of said doveways with each slide block of said slide block means being rounded at its inner end and being bevelled at its outer end, each of said slide blocks also having an aperture extending therethrough, and further defining a T-nut slot on its bottom surface at its rounded inner end with a vertically upwardly extending slide block screwhole depending through said T-nut slot and said slide block inner end.

5. The apparatus of claim 2 wherein each satellite wheel includes a generally flat grinding head and a generally cylindrical body portion with an aperture extending therethrough, said grinding head and said body portion forming a unitary structure.

6. The apparatus of claim 4 wherein said slide blocks may be squared at their inner ends.

7. The apparatus of claim 4 wherein a T-nut is disposed in each of said T-nut slots, each of said T-nuts including a square base portion with a vertically upwardly extending nose, each of said T-nuts further having an aperture extending therethrough into which an adjustment screw is inserted for connection of said slide blocks within said doveways.

8. The apparatus of claim 5 wherein each of said satellite wheels is retained within said aperture of said slide blocks by a slide block bushing, the outer circumferential surface of said slide block bushing being of smaller diameter than the inner circumferential surface of said slide block aperture, said slide block bushing being retained within slide block aperture by a slide block pin, said slide block pin being disposed to a slide block pin screwhole being appropriately situated on the bevelled outer end of said slide block to bear against said slide block bushing.

9. The apparatus of claim 5 wherein said satellite wheel is retained within said slide block by a retainer washer, said retainer washer being disposed within a retainer washer slot actuated on the bottom surface beneath slide block, said retainer washer having an angled aperture disposed through the center thereof, whereby a satellite wheel screw may be inserted therethrough for connection to said satellite wheel.

10. The apparatus of claim 3 wherein said coupler ball is secured within said centrally located aperture of said planetary wheel by a coupler support and a coupler bearing.

11. The apparatus of claim 10 wherein said coupler ball includes a spherical coupler ball head and a cylindrical shaft extension through which rotational movement is imparted through said coupler ball to said planetary wheel.

12. The apparatus of claim 10 wherein said coupler support comprises:

(a) an upwardly vertically extending annular shoulder;

(b) a pair of radial slots disposed 180° apart on the inner circumferential surface of said coupler support, said slots being disposed completely through said annular shoulder and for a distance into the annular surface of said coupler support;

(c) a plurality of semi-circular coupler support screw holes situated approximately 120° apart and extending through portions of said annular shoulder into said annular surface of said coupler support; and, (d) a coupler pin hole defined through a portion of said annular shoulder into said annular surface of said coupler support.

13. The apparatus of claim 10 wherein said coupler support is of generally flat circular configuration with an axially aligned aperture extending therethrough.

14. The apparatus of claim 10 wherein said coupler bearing comprises a generally flat circular body with an axially aligned aperture extending therethrough, said coupler bearing further including a plurality of coupler bearing screw holes, a coupler pin hole defined through its annular surface and an inwardly axially extending shoulder.

15. The apparatus of claim 12 wherein said coupler support and said coupler bearing are mated and joined around said coupler ball by coupler screws.

16. The apparatus of claim 10 wherein said coupler ball further includes a coupler ball slot into which is disposed a coupler ball pin which is confined within radial slots of said coupler support upon assembly.

17. The apparatus of claim 2 wherein said slide blocks may be utilized to adjust said satellite wheels at an angle selected to match the angle of relief of a particular vavle seat or faying ring.

18. A method for grinding a plane annular valve seat surface utilizing apparatus as herein described comprising the steps of:

(a) positioning the axes of the satellite wheels at a selected angle with respect to the axis of the planetary wheels;

(b) adjusting the satellite wheels to an appropriate radial distance from the center of the planetary wheel so as to correspond to the diameter of the annular surface to be ground;

(c) rotating said planetary wheel by an appropriate drive means; and, (d) frictionally engaging the satellite wheels with the annular surface to be ground so that said satellite wheels are caused to rotate about their respective axes as said planetary wheel is rotated by said drive means and thereby to cause the grinding surface of the satellite wheels to grind said annular surface at said selected angle.

* * * * *